US007152772B2

(12) United States Patent
Ukitsu et al.

(10) Patent No.: US 7,152,772 B2
(45) Date of Patent: Dec. 26, 2006

(54) DIAPER BAG

(75) Inventors: Yutaka Ukitsu, Tokyo-To (JP); Toshiro Yoshie, Tokyo-To (JP); Tokihiko Ikuno, Tokyo-To (JP)

(73) Assignee: Combi Corporation, Tokyo (JP)

( * ) Notice: Subject to any disclaimer, the term of this patent is extended or adjusted under 35 U.S.C. 154(b) by 0 days.

(21) Appl. No.: 10/373,695

(22) Filed: Feb. 27, 2003

(65) Prior Publication Data

US 2003/0164321 A1 Sep. 4, 2003

(30) Foreign Application Priority Data

Mar. 1, 2002 (JP) ..... 2002-055390

(51) Int. Cl.
*B65D 69/00* (2006.01)

(52) U.S. Cl. ..... 224/660; 224/652; 224/653; 190/108

(58) Field of Classification Search ..... 190/111, 190/109, 112, 108; 224/652, 653, 153, 576, 224/577

See application file for complete search history.

(56) References Cited

U.S. PATENT DOCUMENTS 4,154,323 A * 5/1979 Sneider ..... 190/2
4,563,777 A * 1/1986 Park ..... 2/108
4,995,436 A * 2/1991 Cantor ..... 150/102
5,062,557 A * 11/1991 Mahvi et al. ..... 224/153
5,547,052 A * 8/1996 Latshaw ..... 190/108
5,649,658 A * 7/1997 Hoffman et al. ..... 224/576
5,743,447 A * 4/1998 McDermott ..... 224/153
5,749,503 A * 5/1998 Wulf et al. ..... 224/153
5,873,504 A * 2/1999 Farmer ..... 224/576
5,934,527 A * 8/1999 Von Neumann ..... 224/153
5,944,155 A * 8/1999 Geary ..... 190/108
5,984,154 A * 11/1999 Scicluna ..... 224/153
6,138,881 A * 10/2000 Paul et al. ..... 224/153
6,230,952 B1 * 5/2001 Jupiter ..... 224/655
6,279,706 B1 * 8/2001 Mao ..... 190/115

FOREIGN PATENT DOCUMENTS

JP 9-65929 * 3/1997

* cited by examiner

*Primary Examiner*—Tri M. Mai
(74) *Attorney, Agent, or Firm*—Birch, Stewart, Kolasch & Birch, LLP

(57) ABSTRACT

A diaper bag body according to the present invention includes a bag body 1, and a storage pocket 10 disposed on a back surface 1*a* facing a user's back of the bag body 1. A folded sheet 13 such as a sheet for changing diapers is contained in the storage pocket 10. A small bag 2 is attached to a front surface 1*b* of the bag body 1.

8 Claims, 6 Drawing Sheets

DIAPER BAG

FIELD OF THE INVENTION

The present invention relates to a diaper bag which can be used as a backpack.

CONVENTIONAL ART

When a mother goes out with a baby, she generally has to bring many articles such as diapers, feeding bottles, and so on, which are necessary for the baby while away from home. A diaper bag has been developed which can sufficiently contain such articles that are necessary for a baby while away from home, and which can be used as a backpack, handbag, and shoulder bag for convenient carriage according to the circumstances.

A conventional diaper bag generally has a cushion material tucked in a surface facing a user's back, in order that a burden applied to a user's back is relieved when used as a backpack. Such a diaper bag may also have a sheet for changing diapers as an accessory, on which a baby is laid when changing diapers away from home. In this case, a storage pocket for containing a soiled sheet is provided outside the bag body, so as to separate the sheet from other articles in the backpack.

However, such a backpack is disadvantageous in that a cushion material must be tucked in a surface facing a user's back, and that a special storage pocket for containing the changing sheet must be provided outside the bag body, as described above.

SUMMARY OF THE INVENTION

In view of the above disadvantages, an object of the present invention is to provide a diaper bag in which, from a sanitary point of view, a soiled sheet is contained in a separate location from other articles contained in the backpack, and the soiled sheet serves as a cushion material for relieving a burden applied to a user's back.

The diaper bag according to the present invention comprises: a bag body having a back surface facing a user's back and a front surface opposite the back surface; and a storage pocket provided openably and closably on the back surface of the bag body; wherein a folded sheet is contained in the storage pocket.

In the diaper bag, the sheet may be one for changing diapers.

In the diaper bag, the sheet for changing diapers may include a core material formed of an expanded resin, and a pair of films sandwiching the core material from both sides.

In the diaper bag, the storage pocket may include a pocket body having an opening, and a cover for covering the opening of the pocket body.

In the diaper bag, the openable and closable cover may be of a rectangular configuration, and may be attached to the pocket body by a U-shaped fastener extending from an upper edge to right and left side edges.

In the diaper bag, a small bag may be detachably attached to the front surface of the bag body.

In the diaper bag, a first fastener and a first surface fastener may be disposed on the front surface of the bag body, and a second fastener for engaging the first fastener and a second surface fastener for engaging the first surface fastener may be disposed on a back surface of the small bag.

In the diaper bag, the bag body may be provided with a swinging piece which covers the first surface fastener and has a third surface fastener for engaging the first surface fastener.

In the diaper bag, the small bag may have a waistbelt-containing portion formed on the back surface thereof, which is for containing therein a waistbelt of the small bag.

In the diaper bag, a mini pocket may be disposed on the front surface of the bag body, and the first fastener may be disposed on the mini pocket to function as an opening and closing fastener of the mini pocket.

DETAILED DESCRIPTION OF THE INVENTION

Figure 1:
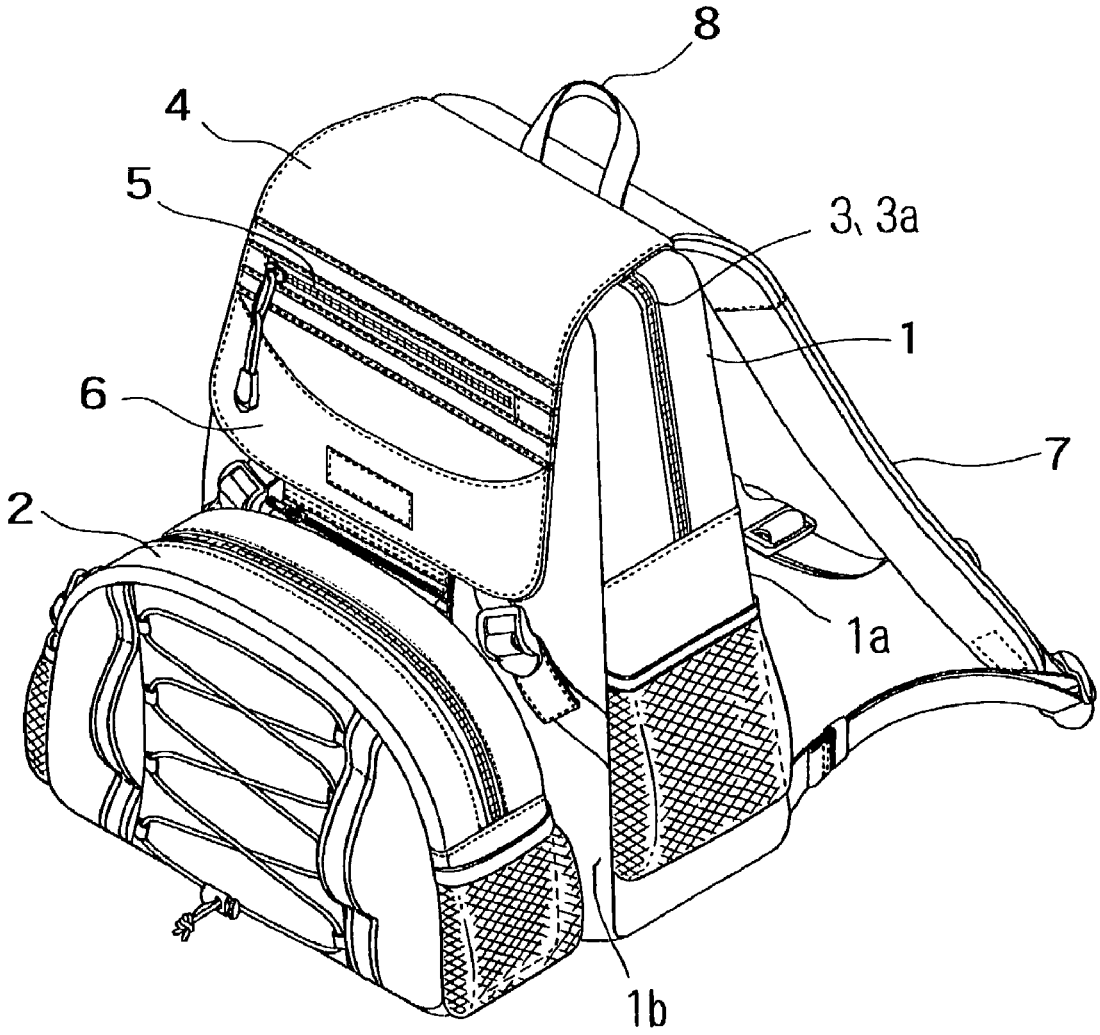
FIG. 1 is a perspective view of a diaper bag according to the present invention.
Figure 2:
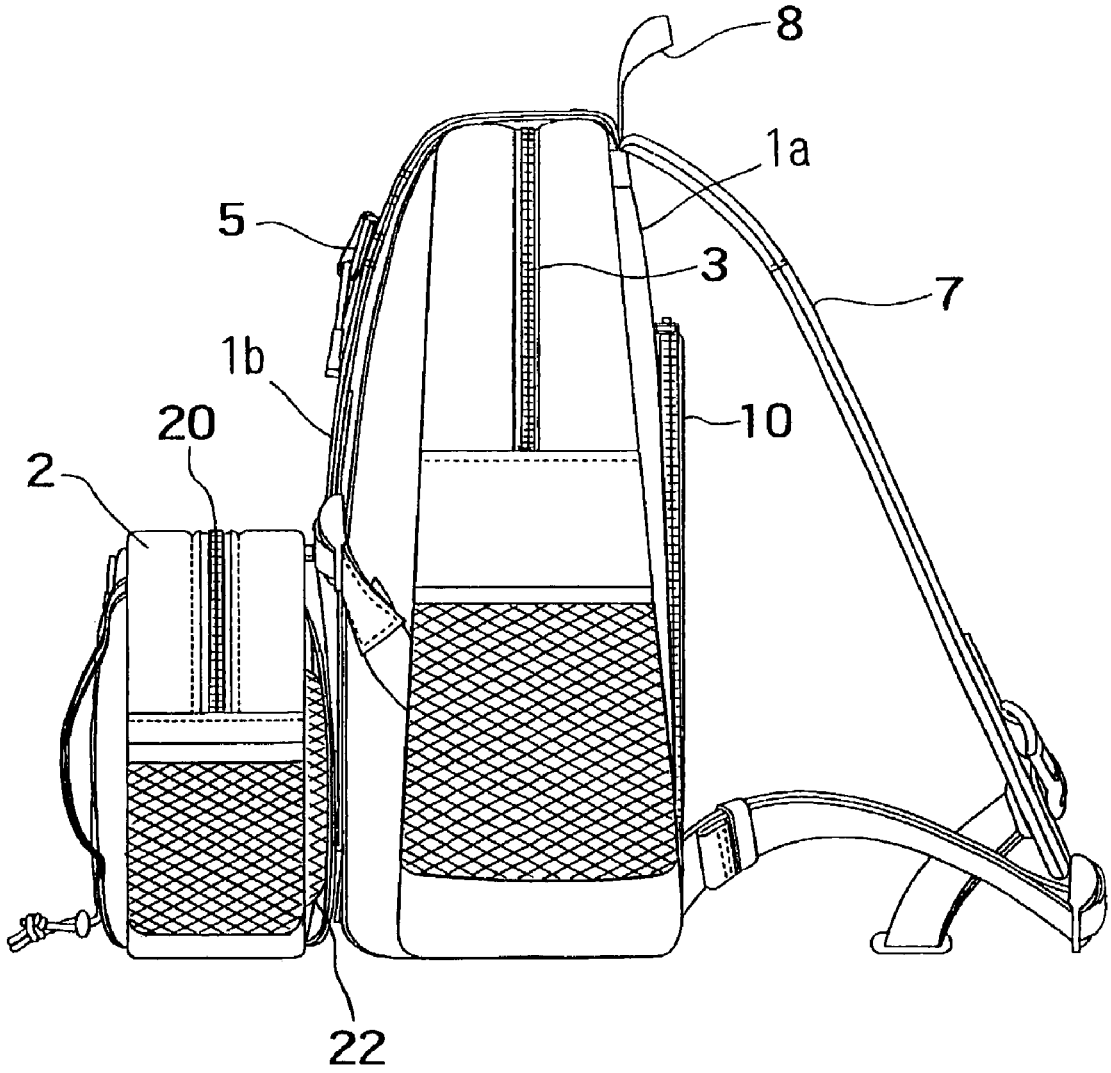
FIG. 2 is a side view of a diaper bag according to the present invention.

An embodiment of the present invention is described below with reference to the attached drawings. FIG. 1 is a perspective view of a diaper bag according to the present invention, and FIG. 2 is a side view thereof. A bag body 1 constituting a large bag has a back surface 1*a* facing a user's back when used as a backpack, and a front surface 1*b* which is opposite the back surface 1*a*. A small bag 2 is detachably attached to the front surface 1*b* of the bag body 1. The bag body 1 has an opening 3*a* at an upper surface thereof which extends to both the right and left side surfaces. The opening 3*a* is provided with a faster 3 which extends to both the right and left side surfaces, whereby the opening 3*a* can be opened and closed by the fastener 3. A cover 4 for covering the fastener 3 is disposed on an upper part of the bag body 1. The cover 4 has a pocket 6 which is opened and closed by a fastener 5.

A shoulder belt 7 is provided on the back surface 1*a* of the bag body 1, and a handle 8 is provided on a top of the back surface 1*a*. Thus, the bag body 1 can be carried by means of the shoulder belt 7 when used as a backpack, as well as by means of the handle 8 when used as a handbag.

Figure 3:
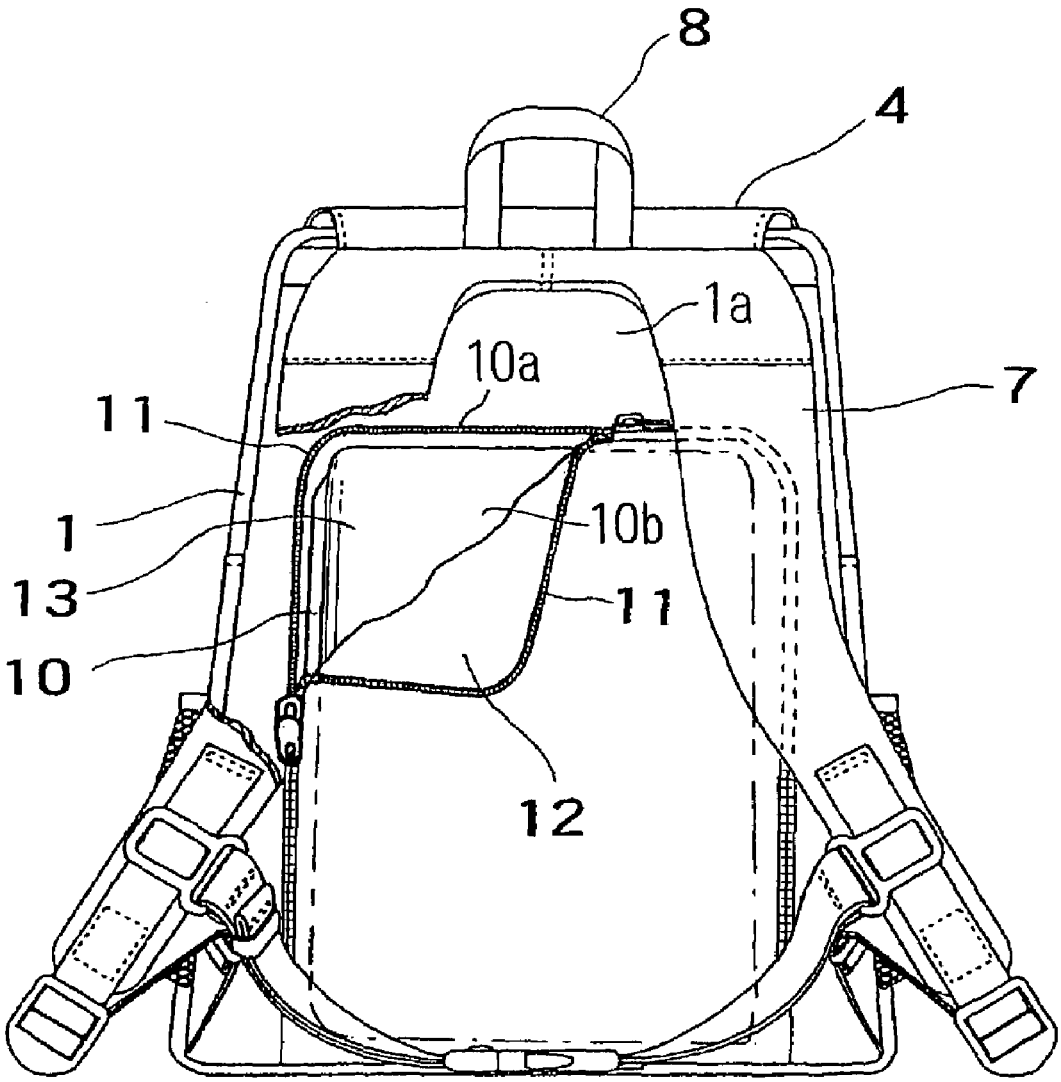
FIG. 3 is a back view of a diaper bag according to the present invention, with a storage pocket on a back surface of a bag body being partially opened.

As shown in FIG. 3, the bag body 1 has a rectangular shaped storage pocket 10 disposed on the back surface 1*a* which faces a user's back when the bag body 1 is used as a backpack. The storage pocket 10 extends substantially all over the back surface 1*a*. The storage pocket 10 includes a pocket body 10*a* having an opening 10*b*, and a rectangular shaped cover 12 for covering the opening 10*b* of the pocket body 10*a*. A fastener 11 is provided on the pocket body 10*a* of the storage pocket 10, and extends from an upper edge of the pocket body 10*a* to the right and left side edges thereof to form an inverted U shape. The cover 12 is downwardly opened by operating the fastener 11 from the outside, so that the opening 10*b* of the pocket body 10*a* of the storage pocket 10 can be spread out. The storage pocket 10 can contain therein a thin, folded sheet for changing diapers 13. The sheet is somewhat resilient so that a baby can be laid thereon when changing diapers.

Figure 4A:
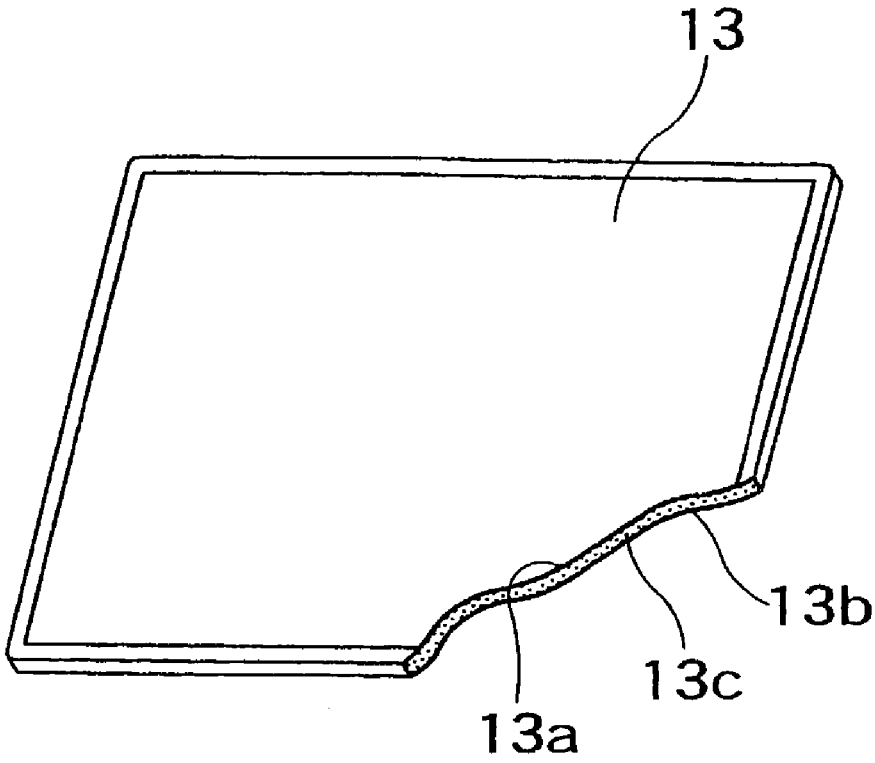
FIG. 4A is a partially broken expanded view showing a sheet for changing diapers.

FIG. 4A is a partially broken expanded view showing the sheet for changing diapers 13. The sheet for changing diapers 13 has a pair of films 13*a* and 13*b* disposed on upper and lower surfaces thereof, and a laminated core material 13*c* which is sandwiched between the films 13*a* and 13*b*, and is resilient like an expanded resin. The sheet for changing diapers 13 may be somewhat resilient so that a baby can be laid thereon when changing diapers.

Figure 4B:
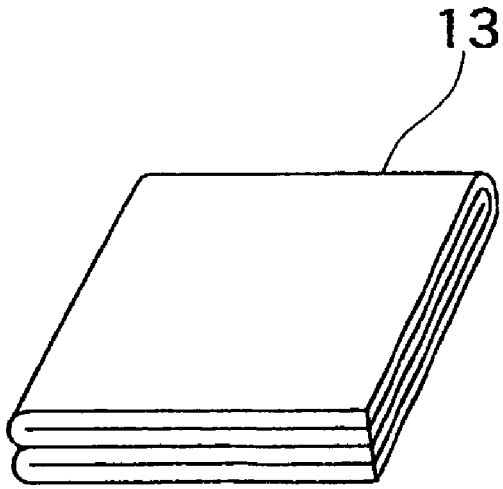
FIG. 4B is a view showing an example of a folded state of a sheet for changing diapers.

When changing diapers of a baby while away from home, the sheet for changing diapers 13 is taken out from the storage pocket 10, and is unfolded as shown in FIG. 4A. The baby is laid on the sheet for changing diapers 13 to change diapers. When the diapers are changed, the sheet for changing diapers 13 is folded as shown in FIG. 4B, for example, and is then returned to the storage pocket 10.

The storage pocket 10 disposed on the back surface 1*a* of the bag body 1 can contain therein the sheet for changing diapers 13 in a folded state. Thus, the soiled sheet 13 can be separated from other articles in the bag body 1, which is advantageous from a sanitary point of view. Further, since the resilient, folded sheet for changing diapers 13 is contained in the storage pocket 10 disposed on the back surface 1*a* facing a user's back of the bag body 1, the sheet for changing diapers 13 can serve as a cushion material to relieve a burden imposed on a user's back by articles contained in the bag body 1. Therefore, the bag body 1 is comfortable when used as a backpack.

Figure 5:
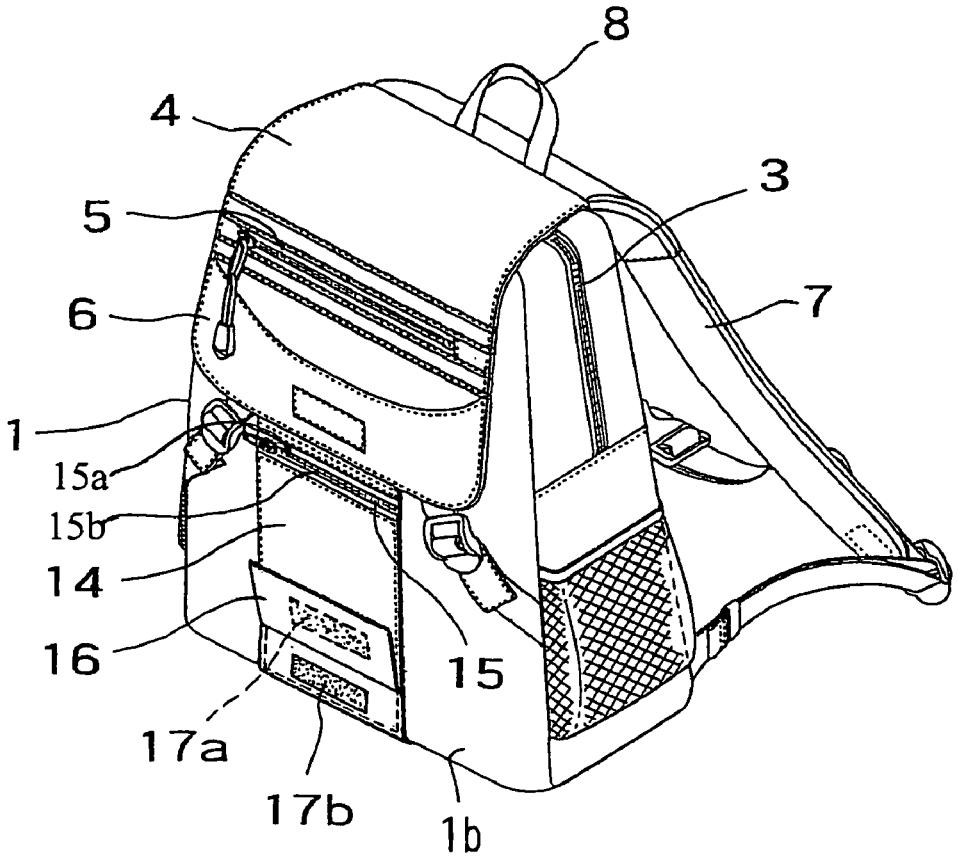
FIG. 5 is a perspective view of a diaper bag according to the present invention, with a small bag detached therefrom.

The detachably small bag 2 is attached to the front surface 1*b* of the bag body 1, as described above. As shown in FIG. 5, the bag body 1 can also be used, with the small bag 2 detached therefrom. FIG. 5 shows a mini pocket 14 disposed on a lower part of the front surface 1*b* of the bag body 1. The mini pocket 14 can be opened and closed by fasteners (first fasteners) 15*a* and 15*b* which transversely extends over the mini pocket 14. A swinging piece 16, which can be upwardly folded back, is arranged on a lower part of the mini pocket 14. A pair of surface fasteners (or hook-and-loop type fasteners) 17*a* and 17*b* are respectively attached to a surface of the swinging piece 16 and an outer surface of the mini pocket 14, with the surfaces opposing each other. The surface fastener 17*a* functions as a third surface fastener, and the surface fastener 17*b* functions as a first surface fastener.

When the small bag 2 is detached from the bag body 1 as stated above, the swinging piece 16 is turned downward to join the surface fasteners 17*a* and 17*b* to each other, so that both surface fasteners 17*a* and 17*b* are covered with the swinging piece 16.

Figure 6:
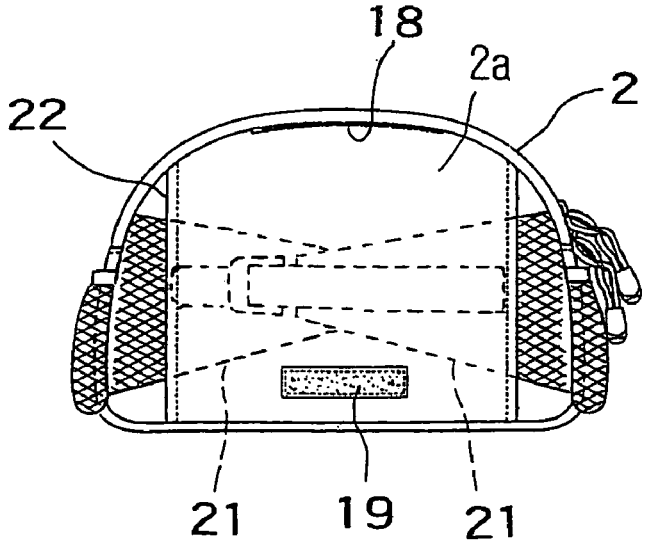
FIG. 6 is a back view of a small bag.
Figure 7:
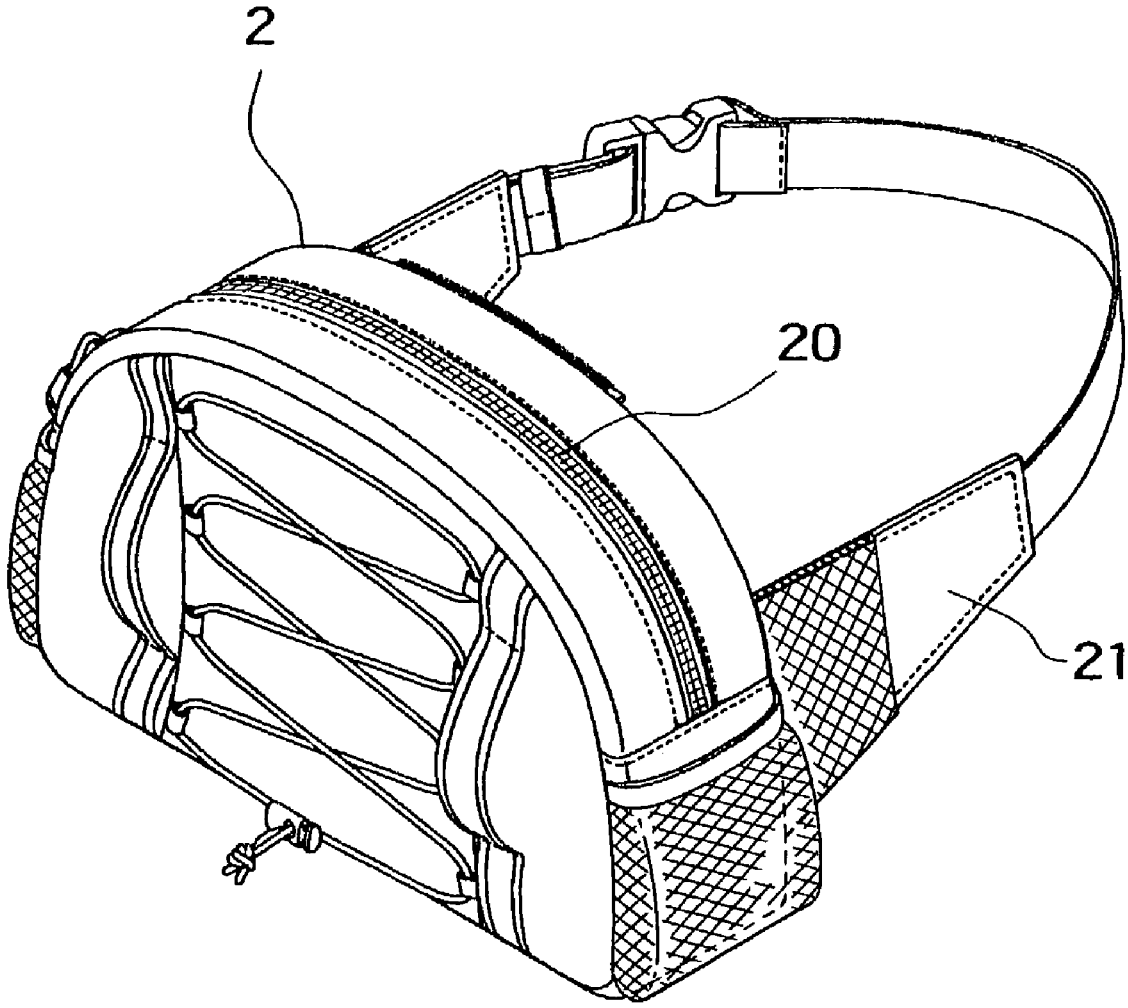
FIG. 7 is a perspective view of a small bag which can be used as a waist pouch.

As shown in FIG. 6, the small bag 2 has a fastener (second fastener) 18 disposed on an upper part of a back surface 2*a* which is opposed to a bag body 1 constituting a large bag. The fastener 18 is connectable to the fastener 15*a* of the mini pocket 14. Fastener 15, which is a zipper fastener, has one side 15*b* which is detachable from the slide at one end. Thus, when fastener 15*b* is in the open position, it is possible to disconnect 15*b* from the slide. Fastener 18 constitutes one side of a similar length zipper fastener. One end of fastener 18 can be inserted into the slide so that fastener 18 can be connected to fastener 15*a* to hold the small bag to the bag body. On a lower part of the back surface 2*a*, there is provided a surface fastener (second surface fastener) 19 which is engageable with the surface faster 17*b* of the bag body 1. As shown in FIG. 7, the small bag 2 has an opening and closing faster 20 disposed at an upper surface thereof. The small bag 2 has a waistbelt 21, such that the small bag 2 can be used as a waist pouch when detached from the bag body 1.

The small bag 2 also has a waistbelt-containing portion 22 formed on the back surface 2*a* thereof, which opens to right and left sides. When the small bag 2 is not used as a waist pouch, the waistbelt 21 can be inserted in the waistbelt-containing portion 22 from right and left sides to be contained therein (FIG. 6).

To attach the small bag 2 to the bag body 1, fastener 15 is fully opened and fastener 15*b* disconnected from the slide, the fastener 18 is connected to the remaining fastener 15*a* disposed on the mini pocket 14 of the bag body 1, with the waistbelt 21 inserted in the waistbelt-containing portion 22 from right and left sides to be contained therein. At the same time, the surface fastener 19 of the small bag 2 is attached to the surface faster 17*b* of the bag body 1 in order to fix the small bag 2 thereto.

In this way, the small bag 2 is attached to and detached from the bag body 1 according to need, and the bag body 1 is used as a backpack as well as a handbag. The detached small bag 2 can be used as a waist pouch when going to a park, shop, and so on in the neighborhood.

As stated above, in the present invention, the large storage pocket 10, which can be opened and closed from the outside, is provided on the back surface 1*a* of the bag body 1, the back surface 1*a* facing a user's back when the bag body 1 is used as a backpack. The storage pocket can contain therein a folded sheet such as a sheet for changing diapers. Accordingly, the following effects are produced therefrom. That is, a soiled sheet can be contained in a separate location from other articles in the bag body, which is preferable from a sanitary point of view. A burden imposed by the articles in the bag body 1 on a user's back can be relieved by a resiliency of the sheet contained in the storage pocket. Further, since the sheet contained in the storage pocket can serve as a cushion material, a conventional cushion material becomes unnecessary.

The invention claimed is:

1. A diaper bag comprising:

a bag body having a back surface facing a user's back and a front surface opposite the back surface;

a storage pocket provided openably and closably on the back surface of the bag body;

wherein a folded sheet is contained in the storage pocket;

a small bag detachably attached to the front surface of the bag body;

a first fastener and a first hook-and-loop fastener disposed on the front surface of the bag body;

a second fastener for engaging the first fastener and a second hook-and-loop fastener for engaging the first hook-and-loop fastener disposed on the back surface of the small bag;

wherein the bag body is provided with a swinging piece which covers the first hook-and-loop fastener and has a third hook-and-loop fastener for engaging the first hook-and-loop fastener.

2. A diaper bag according to claim 1, wherein the sheet is one for changing diapers.

3. A diaper bag according to claim 2, wherein the sheet for changing diapers includes a core material formed of an expanded resin, and a pair of films sandwiching the core material from both sides.

4. A diaper bag according to claim 1, wherein the storage pocket includes a pocket body having an opening, and a cover for covering the opening of the pocket body.

5. A diaper bag according to claim 4, wherein the openable and closable cover is of a rectangular configuration, and is attached to the pocket body by a U-shaped fastener extending from an upper edge to right and left side edges.

6. A diaper bag according to claim 1, wherein the small bag has a waistbelt and a waistbelt-containing portion formed on the back surface thereof, which is for containing therein the waistbelt.

7. A diaper bag according to claim 1, wherein a mini pocket is disposed on the front surface of the bag body, and the first fastener is disposed on the mini pocket to function as an opening and closing fastener of the mini pocket.

8. A diaper bag according to claim 1, wherein the diaper bag is carried on the user's back.

* * * * *